US006101777A

United States Patent [19]

Bodine et al.

[11] Patent Number: 6,101,777

[45] **Date of Patent: *Aug. 15, 2000**

[54] SUSPENSION CEILING SYSTEM

[75] Inventors: Darryl C. Bodine, Lancaster; William C. Dorsey, Conestoga, both of Pa.

[73] Assignee: Armstrong World Industries, Inc., Lancaster, Pa.

[ * ] Notice: This patent is subject to a terminal disclaimer.

[21] Appl. No.: 09/088,086

[22] Filed: Jun. 1, 1998

Related U.S. Application Data

[63] Continuation-in-part of application No. 08/839,126, Apr. 23, 1997.

[51] Int. Cl.[7] ..... E04B 9/00

[52] U.S. Cl. ..... 52/506.06; 52/506.08; 52/582.1

[58] Field of Search ..... 52/506.06, 582.1, 52/465, 506.08

[56] References Cited

U.S. PATENT DOCUMENTS

| | | | |
|---|---|---|---|
| 1,854,938 | 4/1932 | Wray . | |
| 1,997,581 | 4/1935 | Heerenetal . | |
| 2,059,483 | 11/1936 | Parsons | 52/506.06 |
| 2,229,064 | 1/1941 | Finch | 52/506.06 |
| 2,710,081 | 6/1955 | Fink . | |
| 2,921,656 | 11/1960 | Goyer . | |
| 2,973,703 | 3/1961 | Jack . | |
| 3,017,973 | 1/1962 | Schwartz | 52/506.06 X |
| 3,082,487 | 3/1963 | Fowler et al. . | |
| 3,228,163 | 1/1966 | Lindstrom . | |
| 3,263,388 | 8/1966 | Bogert | 52/506.06 X |
| 3,671,061 | 6/1972 | Dawdy | 52/506.06 X |
| 4,112,550 | 9/1978 | DeWitt et al. . | |
| 4,452,021 | 6/1984 | Anderson . | |
| 4,463,537 | 8/1984 | Rodriquez et al. . | |
| 4,520,607 | 6/1985 | Suckow | 52/489.1 |
| 4,640,064 | 2/1987 | Goodworth, II | 52/145 |
| 4,720,946 | 1/1988 | Pagliarello | 52/506.06 X |
| 4,848,054 | 7/1989 | Blitzer et al. . | |
| 5,579,624 | 12/1996 | Aeberhard . | |
| 5,644,878 | 7/1997 | Wehrmann | 52/489.2 X |
| 5,893,250 | 4/1999 | Benvenuto et al. | 52/506.06 X |

FOREIGN PATENT DOCUMENTS

| | | | |
|---|---|---|---|
| 2517-722 | 6/1983 | France | 52/506.06 |

*Primary Examiner*—Beth A. Aubrey
*Assistant Examiner*—Brian E. Glessner
*Attorney, Agent, or Firm*—Womble Carlyle Sandridge & Rice

[57] ABSTRACT

A suspended ceiling system has a plurality of ceiling panels and a plurality of clips holding the ceiling panels to the ceiling runners. Each ceiling panel has two opposed surfaces and four sides with at least two sides having an extended edge each of which are substantially perpendicular to one of the opposed surfaces. Each extended edge has at least one protruding lip.

The upper portion of each clip has a flange to attach the clip to a ceiling surface by suitable means which goes through the flange and penetrates the ceiling. The lower portion of each clip has two opposed, protruding members which are substantially perpendicular to the ceiling surface when the clip is attached to the ceiling. At least one of the protruding members has a groove shaped to receive the protruding lip of the ceiling panel. The protruding members of the clip are set far enough apart to allow the extended edge of at least one ceiling panel to be inserted between the members with the protruding lip on the extended edge of the panel fitting into the groove on the protruding member of the clip to thereby fix the ceiling panel to the clip attached to the ceiling.

5 Claims, 3 Drawing Sheets

SUSPENSION CEILING SYSTEM

CROSS-REFERENCE TO RELATED APPLICATIONS

This application is a continuation-in-part of application Ser. No. 08/839,126, filed Apr. 23, 1997.

BACKGROUND OF THE INVENTION

Field of the Invention

This invention relates to a suspended ceiling system having ceiling panels, T-bar shaped beams (ceiling runners) joined to create a grid, and clips which can be attached to the grid for holding the ceiling panels thereto. Advantageously, the clips of the present invention allow the easy removal of the ceiling panels. In addition to this, the clips can also be easily attached to or removed from the grid.

Systems of suspended ceiling panels have been popular for both commercial and residential buildings. These systems allow the installation of a ceiling which can be acoustically absorbent and is aesthetically pleasing. These ceiling systems, moreover, can be quickly and easily installed. The ceiling systems are particularly desired for hiding pipes, wiring, and duct systems that are common in many buildings.

Suspension ceilings having a variety of different features directed to the attachment of ceiling panels to a ceiling grid have been developed. One suspension ceiling system is disclosed in U.S. Pat. No. 4,640,064. This system combines snap-up pans and lay-in panels. The system includes runners formed with channels formed by opposed lateral flanges, depending side walls and inturned lips. Yet another system is described by U.S. Pat. No. 2,059,483 which requires a channel bar and clips which are inserted into the channel of the channel bar. The clips are attached to building panels which are thereby held to the channel bar. U.S. Pat. No. 4,463,537 describes a suspended ceiling or wall system employing clips fabricated to permit the semi-permanent attachment of the individual clips to a suspended grid tee system. The system contains a clip leg with extruded wands angling therefrom for frictionally coupling decorative molding thereto. The molding system, in turn, supports a plurality of decorative plaques.

U.S. Pat. No. 4,463,537 describes a clip for suspending ceiling panels. The clip, at one end, attaches to the ceiling panel, and at the other end, has a hook element for removably attaching to an existing ceiling panel grid.

Even though there is a variety of suspended ceiling systems there is still a need for a suspended ceiling system which provides easily removable panels which can also be easily attached to the ceiling runner grid system. In addition to this, for cosmetic purposes, the ceiling system should preferably not show any part of the ceiling runners after the suspended ceiling has been installed. The present invention provides such a ceiling system.

DESCRIPTION OF THE INVENTION

A suspended ceiling system has a plurality of ceiling panels, and a plurality of clips holding the ceiling panels to the ceiling runners. Each clip has (as its upper portion) either 1) a single flange with a right end and a left end or 2) it has both a right flange and a left flange. The right and left end of the single flange, and the right and left flanges either 1) are thin enough to allow the means for attachment to a ceiling surface to go through the flange and fix the clip to the ceiling, or 2) have holes so that the means for attachment to the ceiling surface (screws, nails, etc) can be put through the hole and the clip thereby attached to the ceiling.

The clip also has a lower portion which holds the panel.

The lower portion of each clip has two opposed, protruding members which are substantially perpendicular to the flange of the clip and to the ceiling surface when the clip is attached to it. At least one of the protruding members has a groove shaped to receive the protruding lip of the ceiling panel. Preferably both protruding members have the grove to receive a protruding lip. The protruding members of the clip are far enough apart to allow the extended edge of at least one ceiling panel to be inserted between the members with the protruding lip on the extended edge of the panel fitting into the groove on the protruding member of the clip to thereby fix the ceiling panel to the clip attached to the ceiling surface. Preferably, the protruding members are far enough apart to allow two ceiling panels to be inserted between them. Each panel can be removed from the ceiling by forcibly pulling it loose from the clips holding it.

Each ceiling panel has two opposed surfaces, (1) and (12) of FIG. 2, and four sides with at least two sides having an extended edge or side wall each of which are substantially perpendicular to and extends beyond the particular opposed surface of the ceiling panel which will face the ceiling surface after the panel has been attached to the clips. Each extended edge has a protruding lip. The length of the protruding lip is limited so that the protruding lip does not extend for the entire length of the extended edge.

In preferred embodiments, each of the two opposed, protruding members has a groove to receive the protruding lip. In such cases it is preferred that the groove on the protruding member of the clip faces the groove of the opposed protruding member. The protruding members are preferably set far enough apart to allow the extended edge of two ceiling panels to be inserted and held by putting the protruding lip in the groove of the clip. The panels are thus held between the protruding members.

When the ceiling panels are inserted, the two ceiling panels should be placed evenly together with the extended edge of one ceiling panel being adjacent to and touching the extended edge of the other ceiling panel, the extended edges of the panels being substantially perpendicular to the ceiling surface. When the extended edges of the ceiling panels are inserted between the members, the protruding lip of each panel fits into the groove on a protruding member of the clip. The clip should already have been fixed to the ceiling surface, thus attaching the two ceiling panels to the ceiling surface.

DETAILED DESCRIPTION OF THE PREFERRED EMBODIMENTS

Figure 1:
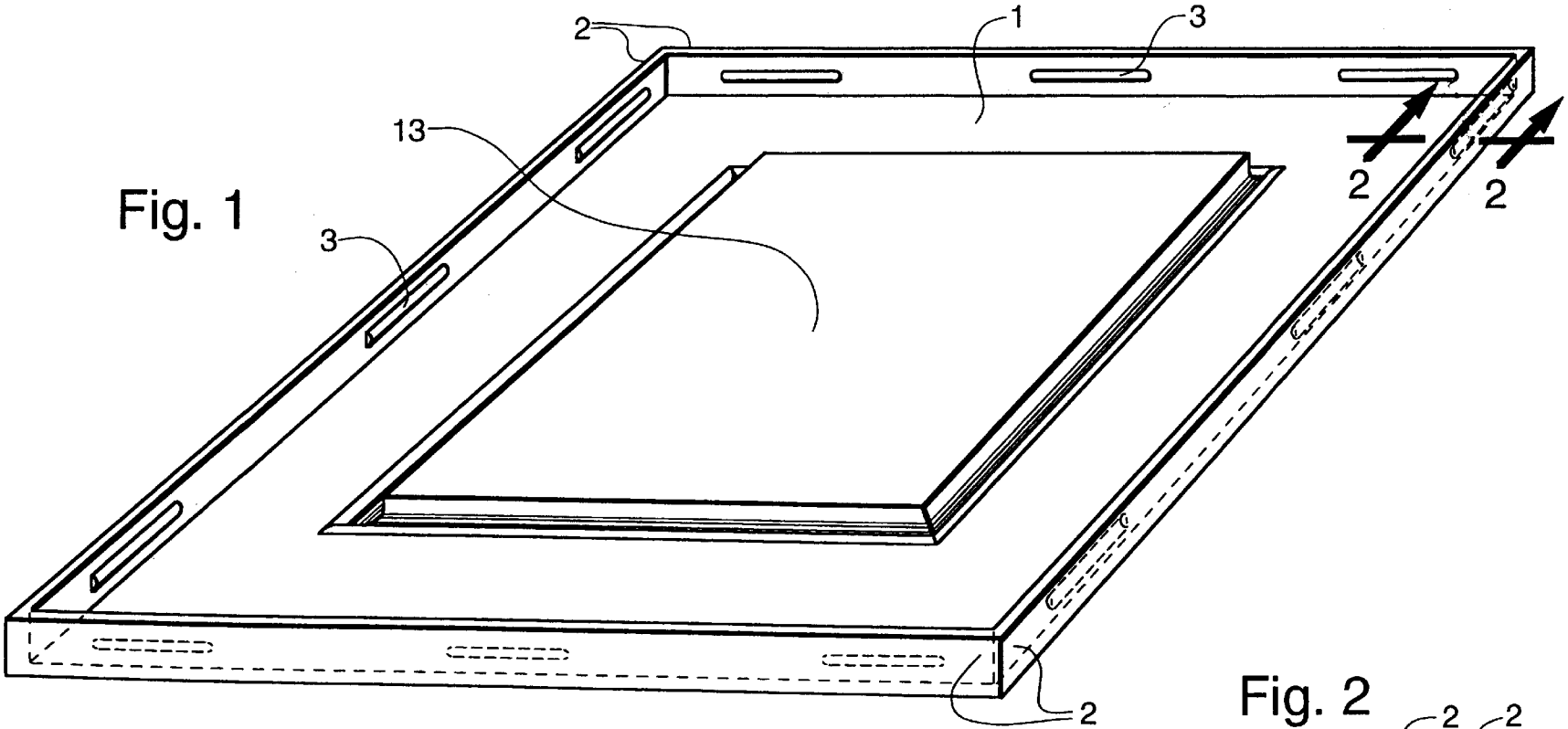
FIG. 1 is a perspective review of a ceiling panel made in accordance with the present invention.

FIG. 1 is a perspective of a ceiling panel (13). In this view, the surface (1) of the ceiling panel which faces up toward the ceiling is shown. On each of the four sides of the panel there is an extended edge (2). On each extended edge the protruding lip can be noted. In fact, in this figure, each extended edge has the preferred three protruding lips.

Figure 2:
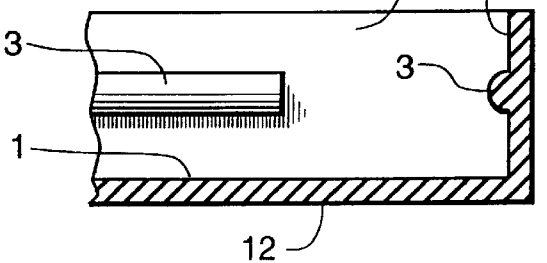
FIG. 2 is an enlarged fragmentary sectional view of a panel taken along 2—2 of FIG. 1.

FIG. 2 is an enlarged fragmentary sectional view of the panel (13) taken on the line 2—2 of FIG. 1. A protruding lip (3) is seen on each of the two edges or side walls (2) of the panel, and the opposing surfaces, (12) and (1) of the panel are seen.

Figure 3:
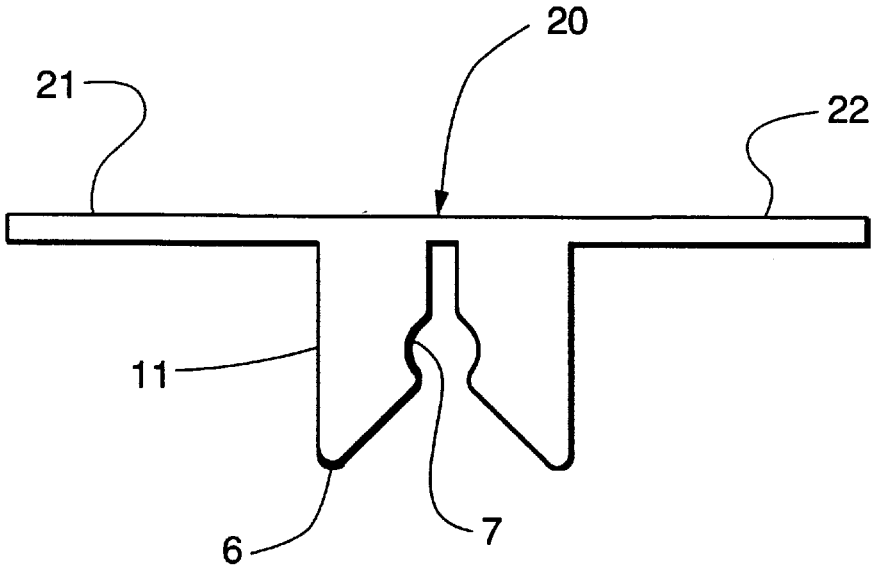
FIG. 3 is an enlarged end view of a first embodiment of a clip in accordance with the present invention.

FIG. 3 shows one embodiment of a clip (11) with the protruding member (6) which has the groove (7) suitable to receive a protruding lip. The single flange (20), which is the upper portion of the clip, has a right side (22) and a left side (21). The right and left sides of the flange of the clip can be driven through with suitable means (nails, screws, staples etc.) to attach the clip to a ceiling surface.

Figure 4:
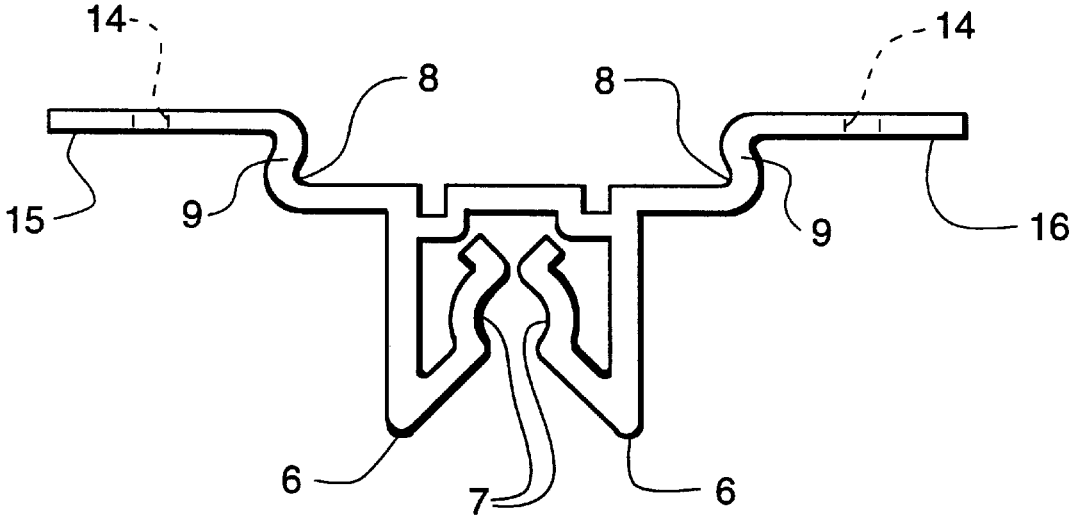
FIG. 4 is an enlarged end view of an alternative embodiment of a clip made in accordance with the present invention.

FIG. 4 is an enlarged end view of another style of clip which has two flanges, the left flange (15) and the right flange (16) as its upper portion. Holes (14) which can be used to put screws or nails through are seen in the flanges, thus making the clip easier to attach to the ceiling. Two protruding members (6) are seen on the clip. These protruding members will be substantially perpendicular to the ceiling surface when the clip is attached to the ceiling. Each protruding member has a groove (7). One protruding lip (3) on a ceiling panel fits into the groove (7). Each lip (9) has a groove (8) which will also receive an edge (5) of a ceiling runner if desired, as an alternate means of installation. The indentation formed between lips (9) is wide enough to receive a flange of a ceiling runner.

Figure 5:
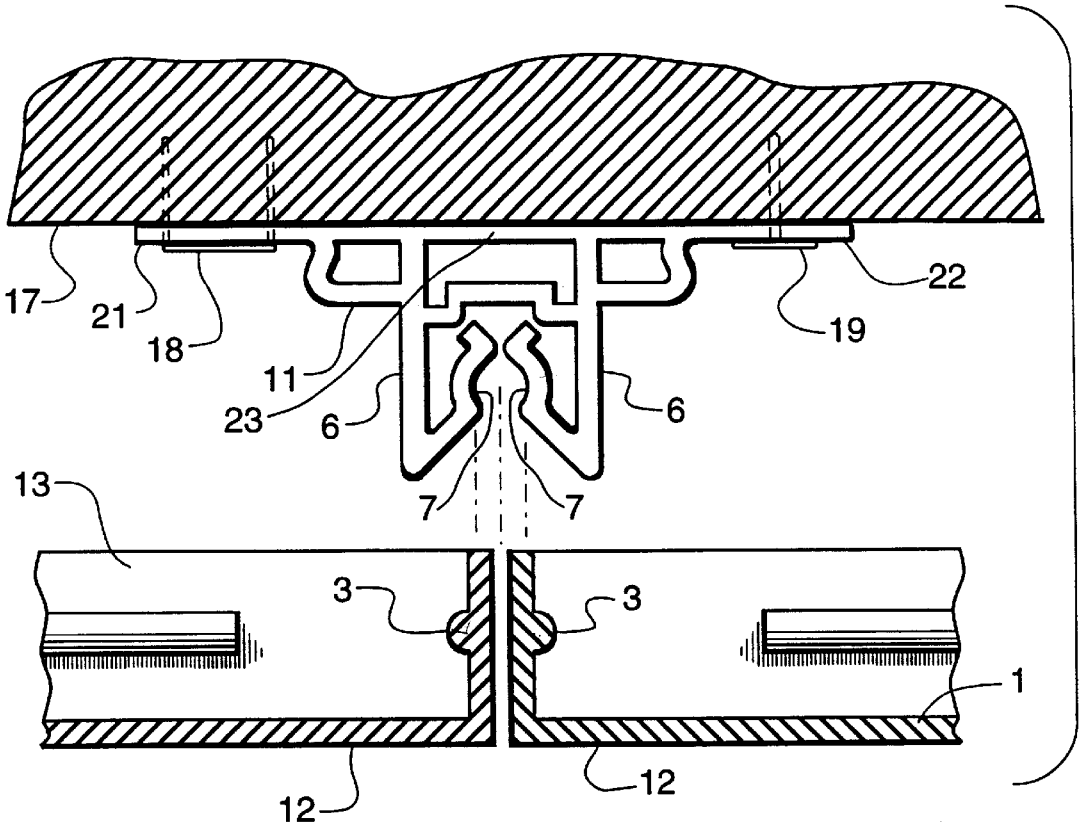
FIG. 5 is a vertical, sectional, exploited view of two panels and a single clip made in accordance with the present invention.

FIG. 5. is a vertical, sectional, exploded view of a ceiling surface (17), a clip (11), and a ceiling panel (13). The ceiling panels are inserted between the protruding members (6) so that the protruding lips (3) fit into grooves (7). In the fig. it is seen that two ceiling panels are being inserted upward so that each protruding lip (3) will be inserted into a groove (7) on the protruding member (6) of the clip. A staple (18) is shown to have been driven through the left side (21) of the single flange (23) The staple (18) goes through the clips flange and into ceiling surface (17) where it is embedded and held, to thereby attach the clip directly to the ceiling. Similarly, a nail (19) is shown to have been driven through right side (22) of the single flange (23) to penetrate the ceiling surface (17) and be embedded in the ceiling where it is held, to thereby fix the clip directly to the ceiling.

Figure 6:
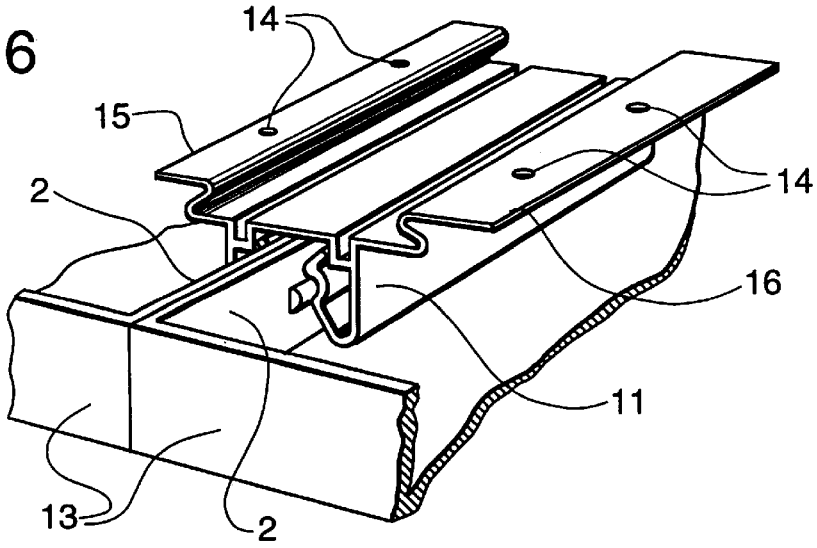
FIG. 6 shows a fragmentary perspective view of the assembled elements of a ceiling system in accordance with the present invention.

FIG. 6 shows a fragmentary perspective view of the assembled elements (clip (11) which holds two ceiling panels (22)). The clip (11) has holes (14) which can be used to put screws or nails through the right flange (16) and the left flange (15) and into a ceiling to fix the clip directly to the ceiling.

Suitably the individual ceiling panels can be pulled loose from the clips holding them. The clips provide a sufficient amount of pinch strength to hold a single panel in place in the suspension ceiling.

If desired, the clips can be extruded using a polymer such as polyvinyl chloride (PVC). In such a case, the polymer clips would advantageously be light in weight. The ceiling runners (also referred to as grid bars) can be made of metal or a polymer such as PVC. The ceiling panel can be made of conventional materials such as wood, metal, or polymer such as PVC.

FIG. 6 shows the preferred embodiment where the clip (11) has a groove (7) on each of the protruding members (6) and each side of the ceiling panel has an extended edge (2). The protruding members are set far enough apart to allow the extended edge of two ceiling panels to be inserted snugly between the members. When the ceiling panels are inserted, the two ceiling panels are preferably placed evenly together with the extended edge (2) of one ceiling panel being adjacent to and touching the extended edge of the other ceiling panel. The extended edges of the panels are substantially perpendicular to the flange of the clip and the ceiling surface, and when the extended edges of the ceiling panels are inserted between the members, a protruding lip on each panel fits into the groove (7) on the protruding member (6) of the clip to fix the two ceiling panels to the ceiling clip.

Ceiling panels (12) may also be removed from the protruding members by translating an end of the lip (3) with respect to and beyond the groove (7) within the protruding member (6), so that the lip clears the groove (7) to allow the ceiling panel to removed vertically from the clip (11).

Suitable means to attach the clip to the ceiling is used. This includes means such as staples, screws and nails that are inserted through the single flange (such as the single flange indicated in FIG. 3) or through the right and left flange (flanges 15 and 16 of the clip (11) of FIG. 6 and 4) Preferably, the clip has holes (14) of FIG. 6, in the flange so that the means to attach the clip can go through the clip easily. Suitably, however, the means can be driven through the flange and into the ceiling surface, as shown by FIG. 5. The means can penetrate the ceiling surface and stick in it to attach the clip to the ceiling surface.

I claim:

1. A suspended ceiling system comprising:

a) a plurality of ceiling panels;

b) a plurality of clips;

c) a surface on a portion of each said ceiling panel, the surface having four sides;

d) at least two side walls, each said side wall extending along its entire respective side, each sidewall extending substantially perpendicular to and beyond the surface;

e) a protruding lip deposed on each side wall, wherein each lip is of a limited length so that each protruding lip does not extend for an entire length of the side wall;

f) an upper portion disposed on each clip, the upper portion having a flat upper surface, whereby the clip is adapted to receive a means to fix the clip to a ceiling surface, such that the flat upper surface is adapted to be attached to the ceiling surface;

g) two opposed, protruding members disposed on each clip, wherein the protruding members are in a substantially vertical orientation, wherein at least one of the protruding members includes a groove that is shaped to receive the protruding lip; and h) wherein the protruding members of the clip are set far enough apart to allow a side wall of at least one ceiling panel to be inserted between the protruding members, whereby the protruding lip on the side wall of the panel is adapted to fit into the groove on the protruding member of the clip to thereby fix the panel to the clip, and wherein the ceiling panel is translatable with respect to the clip such that an end of the lip may pass beyond the groove within the protruding member to allow the ceiling panel to be removed from the clip.

2. The suspended ceiling system of claim 1 wherein each protruding member includes a groove adapted to receive the protruding lip, and wherein the protruding members are sufficiently separated to allow adjacently positioned side walls of two separate panels to be inserted between the protruding members.

3. The suspended ceiling system of claim 1 wherein each ceiling panel is adapted to be removable from the ceiling system by forcibly pulling the panel out of each clip.

4. The suspended ceiling system of claim 1 wherein each side of each ceiling panel includes a side wall.

5. The suspended ceiling system of claim 1 further comprising:

a depression defined between opposing edges in a center portion of the flat surface of the upper portion of the clip, wherein the depression is adapted to receive a runner within a ceiling grid system and wherein the opposing edges are adapted to engage lateral sides of the runner to retain the runner within the depression.

* * * * *